US010251216B2

(12) United States Patent
Cha

(10) Patent No.: US 10,251,216 B2
(45) Date of Patent: Apr. 2, 2019

(54) COOKING APPLIANCE AND CONTROL METHOD OF THE SAME

(71) Applicant: LG ELECTRONICS INC., Seoul (KR)

(72) Inventor: Jungmin Cha, Seoul (KR)

(73) Assignee: LG Electronics Inc., Seoul (KR)

( * ) Notice: Subject to any disclaimer, the term of this patent is extended or adjusted under 35 U.S.C. 154(b) by 25 days.

(21) Appl. No.: 14/993,709

(22) Filed: Jan. 12, 2016

(65) Prior Publication Data

US 2016/0270154 A1 Sep. 15, 2016

(30) Foreign Application Priority Data

Mar. 11, 2015 (KR) ..... 10-2015-0033977

(51) Int. Cl.
*H05B 1/02* (2006.01)
*F24C 7/08* (2006.01)

(52) U.S. Cl.
CPC ..... *H05B 1/0266* (2013.01); *F24C 7/088* (2013.01)

(58) Field of Classification Search
CPC ..... H01L 21/67248; G05D 23/1951; A45D 4/18; F24C 7/082; F24C 7/088; H05B 1/0266
USPC ..... 219/492, 483, 498, 482, 490, 579, 494, 219/509; 99/492, 483, 498, 482, 490, 99/579
See application file for complete search history.

(56) References Cited

U.S. PATENT DOCUMENTS 3,221,318 A * 11/1965 Quirk ..... F24C 15/106 200/5 F
3,339,054 A * 8/1967 Deaton ..... H05B 6/6402 219/685
3,353,004 A * 11/1967 Alexander ..... F24C 14/02 219/393
3,448,244 A * 6/1969 Filipak ..... F24C 14/02 219/412
3,518,949 A * 7/1970 Stock ..... A21C 13/00 219/400
3,591,769 A * 7/1971 Manecke ..... F24C 14/02 219/494
3,639,726 A * 2/1972 Holtkamp ..... F24C 14/02 219/393
3,766,437 A * 10/1973 Fritts ..... H05B 6/6417 219/722

(Continued)

FOREIGN PATENT DOCUMENTS

JP 2000-315573 11/2000
JP 2010-146897 7/2010

(Continued)

*Primary Examiner* — Jimmy Chou
(74) *Attorney, Agent, or Firm* — Fish & Richardson P.C.

(57) ABSTRACT

A cooking appliance is disclosed. The cooking appliance includes an electric heater for heating an object to be cooked, a mechanical manipulation unit connected to the electric heater for allowing a user to input primary ON/OFF of the electric heater and power of the electric heater, a normal open type DC relay connected to the manipulation unit, and a controller for controlling the DC relay to control secondary ON/OFF of the electric heater based on sensing of a primary ON state of the electric heater by the manipulation unit (a state in which the manipulation unit is operated).

15 Claims, 4 Drawing Sheets

(56) References Cited

U.S. PATENT DOCUMENTS 3,816,688 A * 6/1974 Fritts ..... H05B 6/6417 219/720
3,912,904 A * 10/1975 Phifer ..... F24C 15/022 126/197
3,919,523 A * 11/1975 Wadia ..... A47J 37/1266 219/441
4,054,769 A * 10/1977 Anderson ..... H05B 6/6417 219/722
4,092,520 A * 5/1978 Holmes ..... G05D 23/2401 219/504
4,307,287 A * 12/1981 Weiss ..... A47J 27/62 219/432
4,527,049 A * 7/1985 Thomas ..... F24C 7/087 219/446.1
5,111,027 A * 5/1992 Fowler ..... F24C 7/087 219/492
5,126,537 A * 6/1992 Kadwell ..... G05D 23/1917 219/497
5,175,413 A * 12/1992 Holling ..... G05D 23/19 219/483
5,235,159 A * 8/1993 Kornrumpf ..... F24C 15/106 219/483
6,399,931 B1 * 6/2002 Kang ..... H05B 6/66 126/197
6,680,463 B2 * 1/2004 Honda ..... H05B 6/6417 219/494
6,713,730 B1 * 3/2004 Zakerin ..... F24C 15/106 219/492
6,781,097 B2 * 8/2004 Graff ..... F24C 7/087 219/414
6,951,997 B2 * 10/2005 Larson ..... H05B 1/0266 219/483
6,967,314 B2 * 11/2005 Sauter ..... H05B 3/68 219/448.12
7,420,142 B2 * 9/2008 Barrena ..... H01H 19/62 219/448.11
8,344,292 B2 * 1/2013 Franca ..... H05B 1/0266 219/443.1
2008/0142505 A1 * 6/2008 Staebler ..... H05B 3/746 219/460.1
2009/0001067 A1 * 1/2009 Bally ..... F24C 15/027 219/392
2009/0001069 A1 * 1/2009 Bally ..... F24C 15/027 219/413
2009/0192657 A1 * 7/2009 Heicks ..... F24C 7/082 700/306
2011/0095017 A1 * 4/2011 Steurer ..... H02J 3/14 219/493
2011/0147366 A1 * 6/2011 Franca ..... H05B 1/0266 219/443.1
2013/0334203 A1 * 12/2013 Legatti ..... H05B 1/0261 219/509
2015/0351163 A1 * 12/2015 Kim ..... H05B 6/1218 99/342
2016/0014849 A1 * 1/2016 Hegedis ..... H05B 6/1263 219/627
2016/0018112 A1 * 1/2016 Phillips ..... F24C 15/10 99/331

FOREIGN PATENT DOCUMENTS

KR 10-2011-0055005 5/2011
KR 10-2013-0029515 3/2013

* cited by examiner

COOKING APPLIANCE AND CONTROL METHOD OF THE SAME

This application claims the benefit of Korean Patent Application No. 10-2015-0033977, filed on Mar. 11, 2015, which is hereby incorporated by reference as if fully set forth herein.

BACKGROUND OF THE INVENTION

Field of the Invention

The present invention relates to a cooking appliance, and more particularly to a cooking appliance that is capable of safely controlling a heater.

Discussion of the Related Art

Cooking appliances are products that cook food using electricity or other kinds of energy at home. Among cooking appliances, there are a gas stove, a gas oven, and a gas oven/stove, which use gas. In the gas stove, the gas oven, and the gas oven/stove, food is cooked using the combustion of gas. In addition, there are an electric cooktop, an electric stove, an electric oven, and an electric oven/stove, which use electricity. In the electric cooktop, the electric stove, the electric oven, and the electric oven/stove, food is cooked using an electric heater. Of course, a single cooking appliance may use both electricity and gas.

FIG. 1 is a side view showing a general oven/stove, which is an example of such a cooking appliance. Of course, the cooking appliance shown in FIG. 1 may be a cooking appliance according to an embodiment of the present invention. That is, FIG. 1 is merely an illustration for describing the construction of a general cooking appliance.

As shown in FIG. 1, a cooking appliance 10 or an oven/stove includes a cabinet 20 defining the external appearance of the cooking appliance. In the cabinet 20 may be defined a chamber 25 for receiving food to be cooked. Of course, the chamber 25 may be omitted from the cooking appliance 10.

A cooktop 26, on which cooking containers are placed, may be provided at the upper side of the cabinet 20. That is, cooking containers, such as pots, may be located on the cooktop 26 such that cooking is performed using heat generated from gas, supplied underneath the cooktop, or using heat generated by an electric heater.

The chamber 25 or the cooktop 26 may be a cooking unit, in which cooking is performed using heat. Based on the kind of cooking appliance, various cooking units may be provided. For example, the cooking unit may be configured such that cooking is performed through the direct use of heat generated by the electric heater or through the radiation or conduction of the heat generated by the electric heater. In a case in which electricity is used, the cooktop 26 may be an example of a cooking unit using conduction of heat, and the chamber 25 maybe an example of a cooking unit using radiation or convention of air.

The cabinet 20 may be provided at the front thereof with a door 50 for opening and closing the chamber 25. A handle 60 may be provided at the door 50. A user may open and close the door 50 while holding the handle 60.

The cooking appliance may include a panel 30, which may be integrally formed with the cabinet 20 or may be coupled to the cabinet 20. The panel 30 may be provided with a user interface including a manipulation unit 40 for allowing a user to control the cooking appliance.

The manipulation unit 40 may be configured to turn the electric heater ON or OFF and to adjust the power of the electric heater. Higher power of the electric heater may mean a larger amount of heat that is generated. The manipulation unit may include a timer. In addition, the manipulation unit may further include a display part for informing the user of cooking information or a current state of the cooking appliance.

In a case in which the electric heater is used in the cooking appliance, the manipulation unit 40 may be provided at the panel 30 in the shape of a knob. The user may manipulate the manipulation unit 40 in order to drive the electric heater, which is located at a specific position in the cooking appliance.

For example, the user may manipulate the manipulation unit 40 in order to drive an electric heater located in the chamber or to drive an electric heater connected to a specific one selected from among a plurality of cooktops.

An electronic manipulation unit or a mechanical manipulation unit may be used as the manipulation unit 40.

A controller may recognize a value input by a user through the electronic manipulation unit 40, and may control ON/OFF and power of the electric heater. To this end, it is necessary to provide a complex circuit and an electronic device. That is, it is necessary to provide a circuit and an electronic device that calculate and supply power of the electric heater using a value input by the user. In the cooking appliance having the electronic manipulation unit, therefore, the controller substantially control ON/OFF and power of the electric heater. However, the manufacturing cost of the cooking appliance having the electronic manipulation uni may be increased, and the cooking appliance may malfunction, by the provision of the circuit and the electronic device.

The mechanical manipulation unit solves the problems caused by the electronic manipulation unit.

The mechanical manipulation unit is a kind of rotary switch. The mechanical manipulation unit may have a bimetal provided therein. That is, an ON/OFF duty ratio of the electric heater is mechanically decided based on an angle by which the user rotates the mechanical manipulation unit. In the cooking appliance having the mechanical manipulation unit, therefore, the mechanical manipulation unit controls ON/OFF and power of the electric heater in place of the controller. Consequently, the cooking appliance may have a simple structure, whereby manufacturing cost of the cooking appliance may be decreased, and a possibility that the cooking appliance will malfunction is relatively low.

Since the cooking appliance is an apparatus that uses heat, safety is critical. In particular, it is necessary to prevent malfunction of the cooking appliance by children. For example, the cooking appliance includes a child lock input unit for preventing the cooking appliance from being operated according to child's manipulation performed through the manipulation unit.

When the user selects the child lock input unit, the electric heater may not be driven even though the manipulation unit is manipulated. The child lock input unit is mainly used for cooking appliances having the electronic manipulation unit.

However, the child lock input unit is not used for cooking appliances having the mechanical manipulation unit since manufacturing cost is considerably increased. Nevertheless, cooking appliances in which the child lock input unit is applied to the mechanical manipulation unit for safety has been provided.

Hereinafter, a conventional cooking appliance having a mechanical manipulation unit and a child lock input unit will be described with reference to FIG. 2.

An alternating current (AC) voltage of, for example, 240 V may be applied between live terminals L1 and L2. A mechanical manipulation unit 40 and a heater 61 may be connected between the live terminals L1 and L2. In addition, an AC relay 62 may be connected between the mechanical manipulation unit 40 and the live terminal L2. The mechanical manipulation unit 40 is provided for primary ON/OFF of the heater 61, and the AC relay 62 is provided for secondary ON/OFF of the heater 61. That is, the heater is driven in a state in which both the mechanical manipulation unit 40 and AC relay 62 are ON.

First, when a user manipulates the mechanical manipulation unit 40 to primarily turn the heater 61 ON, the heater is driven since the AC relay 62 is in a normally closed state. That is, since a normal close (NC) type AC relay 62 is used, the heater 61 is driven when the user rotates the mechanical manipulation unit 40.

A child lock input unit 80 may be selected in order to prevent user's incorrect manipulation. That is, when the child lock input unit 80 is selected, the heater must not be driven even though the heater 61 is primarily turned ON through the mechanical manipulation unit 40. When the child lock input unit 80 is selected, therefore, the AC relay 62 must be open. That is, the AC relay 62 is driven such that the state of the AC relay 62 is switched from a closed state to an open state. To this end, a normal open (NO) type DC relay 63 may be connected to the AC relay 62.

The DC relay 63 is driven through the controller 70. That is, the DC relay 63 is controlled according to a DC signal applied from the controller 70. When the controller 70 applies a DC signal to the DC relay 63, the DC relay 63 is switched to a closed state. When the controller 70 does not apply a DC signal to the DC relay 63, the DC relay 63 may be maintained in an open state.

The controller 79 applies a DC signal to the DC relay 63 in a state in which the child lock input unit 80 is selected. That is, the controller 70 applies a DC signal to the DC relay 63 to turn the DC relay 63 ON. Of course, the controller 70 may not apply a DC signal to the DC relay 6 in a state in which the child lock input unit 80 is not selected, which may be referred to as application of an OFF signal, which is distinguished from an ON signal.

In a state in which the DC relay 63 is closed, the DC relay 63 applies an AC signal to the AC relay 62. The AC relay 62 is an NC type AC relay 62. When an AC signal is applied to the AC relay 62, therefore, the AC relay 62 is switched to an open state. Of course, when no AC signal is applied to the AC relay 62, the AC relay 62 is maintained in a closed state.

When the cooking appliance has the conventional mechanical manipulation unit 40 and the child lock input unit 80, therefore, the NC type AC relay 62 and the NO type DC relay 63 must be provided. The AC relay is a relay that is driven according to an AC signal, and the DC relay is a relay that is driven according to a DC signal.

Since the conventional cooking appliance uses the NC type AC relay 62 and the NO type DC relay 63, points to be wired are increased with the result that a manufacturing process is complicated. In addition, the NC type AC relay 62 is expensive. As a result, manufacturing cost of the cooking appliance is increased. For these reasons, the child lock input unit 80 may not be applied to inexpensive cooking appliances.

In a case in which there is no input through the child lock input unit 80, the relay connected to the mechanical manipulation unit 40 must be configured to drive the heater 61. That is, the relay must be an NC type relay. Electric current used for the NC type relay is fixed, and only the AC relay is applied in consideration of electric current used in the cooking appliance. This is because the maximum current for the NC type DC relay is remarkably lower than the maximum current for the NO type DC relay. For example, the maximum current for the NC type DC relay may be 15 A, and the maximum current for the NO type DC relay may be 30 A. However, both the NO type AC relay and the NC type AC relay may have a maximum current of 30 A. When considering the number of heaters in the cooking appliance and margins of the cooking appliance, the NC type AC relay is used in place of the NC type DC relay.

As a result, the manufacturing cost of the conventional cooking appliance is increased by the provision of the AC relay, and the manufacturing process of the cooking appliance is complicated due to the increase in number of points to be wired.

SUMMARY OF THE INVENTION

Accordingly, the present invention is directed to a cooking appliance and a control method of the same that substantially obviate one or more problems due to limitations and disadvantages of the related art.

An object of the present invention is to provide a cooking appliance that can be manufactured with low cost and improved workability and a control method of the same.

Another object of the present invention is to provide a cooking appliance that is capable of safely driving an electric heater and a control method of the same.

Another object of the present invention is to provide a cooking appliance that enables a user to easily control an electric heater and a control method of the same.

Another object of the present invention is to provide a cooking appliance that is capable of preventing user's incorrect manipulation, particularly child's incorrect manipulation, by the provision of a child lock input unit and a control method of the same.

A further object of the present invention is to provide a cooking appliance that is capable of maintaining the driving of an electric heater even though a child lock input unit is selected a state in which the electric heater is driven, thereby improving convenience in use, and a control method of the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a cooking appliance includes an electric heater for heating an object to be cooked, a mechanical manipulation unit connected to the electric heater for allowing a user to input primary ON/OFF of the electric heater and power of the electric heater, a normal open type DC relay connected to the manipulation unit, and a controller for controlling the DC relay to control secondary ON/OFF of the electric heater based on sensing of a primary ON state of the electric heater by the manipulation unit (a state in which the manipulation unit is operated).

The DC relay may be connected in series to the electric heater.

Specifically, in a case in which AC voltage is applied between a live terminal L1 (positive) and a live terminal L2 (negative), wiring may be achieved in order of the live terminal L1, the mechanical manipulation unit (positive), the electric heater, the mechanical manipulation unit (negative), the DC relay, and the live terminal L2. That is, electric current may flow in order as described above. In a case in which electric current flows in order as described above, therefore, the electric heater is driven. In a case in which the flow of electric current is interrupted at any one of the above-mentioned elements, the electric heater is not driven. Elements at which the flow of electric current is interrupted may be the mechanical manipulation unit and the DC relay. For this reason, the mechanical manipulation unit may have a double switch structure.

The mechanical manipulation unit may be a mechanical switch configured to be rotated in order to perform the primary ON/OFF of the electric heater. In addition, the mechanical manipulation unit may control the power of the electric heater in a state in which the electric heater is ON.

An ON/OFF duty ratio of the electric heater may be increased with the increase of a rotational angle of the mechanical manipulation unit. That is, the duty ratio of the electric heater may be increased with increase of a rotational angle of the mechanical manipulation unit rotated by the user.

Consequently, the mechanical manipulation unit may directly control the power of the electric heater.

Meanwhile, since the NO type DC relay is applied, the electric heater is not driven when the user primarily operate the mechanical manipulation unit. For this reason, it is necessary to provide an element for switching the DC relay to a closed state or it is necessary to control the DC relay to be switched to a closed state. This means that the electric heater may be more safely used.

The cooking appliance may further include a child lock input unit for preventing user's incorrect input or incorrect manipulation. The child lock input unit may be configured to restrict a specific user, such as a child who is not accustomed to using the cooking appliance, from using the cooking appliance. The child lock input unit may be configured to be selected by the user. In a case in which the user selects the child lock input unit, child lock may be set. This lock may be lock of the entire cooking appliance, particularly lock of the electric heater. That is, the electric heater may not be driven even through the mechanical manipulation unit is manipulated.

The controller may control the secondary ON/OFF of the electric heater based on whether child lock has been set through the child lock input unit. That is, in a case in which the child lock has been set, the controller may turn the electric heater OFF. Consequently, the electric heater is not driven even though the electric heater has been primarily turned ON by the manipulation unit. On the other hand, in a case in which the child lock has been released, the controller may turn the electric heater ON. Consequently, the electric heater is driven according to primary heater ON by the mechanical manipulation unit and secondary heater ON through the DC relay. In other words, the electric heater may be operated only when both a state in which the manipulation unit is operated and a state in which the DC relay is closed are satisfied.

When the child lock has been set through the child lock input unit, the controller may control the DC relay to be maintained in a normal open state even in a state in which the manipulation is operated.

When the child lock has not been set through the child lock input unit, the controller may control the DC relay to be switched to a closed state.

The cooking appliance may further include a photo coupler for sensing a state in which the manipulation unit is operated. The controller may control the child lock input unit to be disabled in a state in which the manipulation unit is operated. That is, the controller may determine whether the mechanical manipulation unit is operated using the photo coupler. Upon determining that the mechanical manipulation unit is operated, therefore, the controller may disable the child lock input unit. Disabling may be not reflecting of an input signal even though input is performed through the child lock input unit or interrupting the reception of an input signal.

By disabling the child lock input unit, it is possible to prevent driving of the electric heater from being stopped by the child lock input unit in a state in which the mechanical manipulation unit is operated, e.g. in a state in which the electric heater is driven. In a case in which incorrect input is performed through the child lock input unit during driving of the electric heater, therefore, it is possible to prevent driving of the electric heater to be stopped. As a result, it is possible to prevent user's confusion.

The cooking appliance may further include a light emitting unit connected to the manipulation unit, and the light emitting unit may be operated when the manipulation unit is operated. Consequently, it is possible for the user to easily recognize through the light emitting unit that the mechanical manipulation unit is operated. The light emitting unit is an element that generates light when electricity is applied thereto. For example, the light emitting unit may be a lamp or a light emitting diode (LED).

In another aspect of the present invention, a cooking appliance includes an electric heater for heating an object to be cooked, a mechanical manipulation unit connected to the electric heater and configured to be manipulated by a user in order to drive the electric heater, a normal open type DC relay connected to the manipulation unit, a sensor for sensing a state in which the manipulation unit is operated, a child lock input unit for preventing user's incorrect input, and a controller for controlling the DC relay to be closed in order to drive the electric heater only when both a state in which the mechanical manipulation unit is operated and a state in which child lock has been released through the child lock input unit are satisfied.

The mechanical manipulation unit may control power of the electric heater, and the controller may control only ON/OFF of the electric heater.

The cooking appliance may further include a light emitting unit connected to the mechanical manipulation unit for emitting light in a state in which the mechanical manipulation unit is operated.

The sensor may be a photo coupler provided between the light emitting unit and the controller.

In a further aspect of the present invention, a control method of a cooking appliance, including an electric heater for heating an object to be cooked, a mechanical manipulation unit configured to be manipulated by a user in order to drive the electric heater, and a child lock input unit, includes determining whether the mechanical manipulation unit is operated (a first step), upon determining at the first step that the mechanical manipulation unit is operated, determining whether child lock has been set through the child lock input unit (a second step), and upon determining at the second step that the child lock has been set through the child lock input unit, maintaining an open state of a normal open type DC relay to prevent driving of the electric heater (a third step).

Specifically, a controller may determine whether the mechanical manipulation unit is operated using a sensor or a photo coupler. In addition, the controller may determine whether child lock has been set through the child lock input unit. Upon determining that the child lock has been set through the child lock input unit, the controller may control the open state of the normal open type DC relay to be maintained. Consequently, the controller may prevent driving of the electric heater even in a state in which the mechanical manipulation unit is operated.

The control method may further include, upon determining at the second step that the child lock has been released through the child lock input unit, closing the normal open type DC relay to drive the electric heater (a fourth step). The controller may determine that the mechanical manipulation unit is operated and that the child lock has been released or not set through the child lock input unit, and may control the normal open type DC relay to be closed. As a result, the electric heater may be finally driven.

Setting of the child lock through the child lock input unit may be prevented during the fourth step. The fourth step may be maintained even though setting of the child lock through the child lock input unit is input during the fourth step. That is, the controller may disable the child lock input unit when the electric heater is finally driven. Consequently, it is possible to prevent driving of the electric heater to be stopped by input through the child lock input unit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIGS. 4 to 6 are wiring diagrams of the cooking appliance shown in FIG. 3, wherein FIG. 4 is a wiring diagram showing an OFF state of a mechanical manipulation unit;

FIG. 5 is a wiring diagram showing an ON state of the mechanical manipulation unit; and FIG. 6 is a wiring diagram in a case in which child lock is not set in a state shown in FIG. 5.

DETAILED DESCRIPTION OF THE INVENTION

Reference will now be made in detail to the preferred embodiments of the present invention, examples of which are illustrated in the accompanying drawings.

Figure 3:
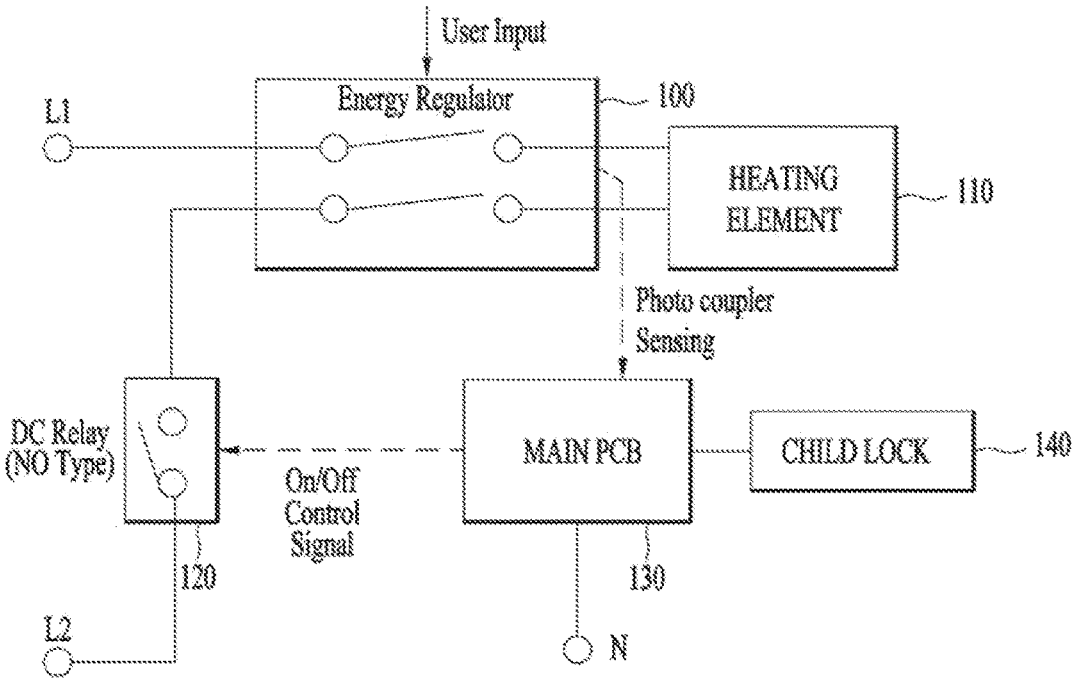
FIG. 3 is a schematic block diagram showing a cooking appliance according to an embodiment of the present invention.

First, control components of a cooking appliance according to an embodiment of the present invention will be described in detail with reference to FIG. 3.

The cooking appliance according to this embodiment may include a mechanical manipulation unit 100 and an electric heater 110. The electric heater 110 is configured to emit heat when electric current flows in the electric heater 110. Consequently, the electric heater 110 operates (emits heat) when electric current is supplied to the electric heater 110, and the electric heater 110 does not operate when the supply of electric current to the electric heater 110 is interrupted.

The mechanical manipulation unit 100 may be formed in the shape of a rotary switch or a rotary knob. The mechanical manipulation unit 100 may have a switch structure therein. When mechanical manipulation unit 100 is operated, therefore, electric current may flow in the switch structure. In an initial state or an OFF state, the switch structure is open with the result that the supply of electric current is interrupted. Consequently, the mechanical manipulation unit 100 may be a mean for primarily supplying electric current to the electric heater 110 or interrupting the supply of electric current to the electric heater 110.

Meanwhile, the mechanical manipulation unit 100 may be a regulator for controlling the temperature of the electric heater in addition to turning the electric heater 110 ON or OFF. A bimetal is provided in the mechanical manipulation unit 100 such that the supply of electric current is automatically interrupted to control the temperature of the electric heater 110 when a predetermined amount of electric current flows in the bimetal. As a rotational angle of the mechanical manipulation unit 100 is increased, an electric current interruption cycle may be increased to adjust the temperature of the electric heater 110.

In other words, the mechanical manipulation unit 100 may be a means for controlling the amount of heat generated by the electric heater 110, i.e. the power of the electric heater 110, in addition to turning the electric heater 110 ON or OFF. The mechanical regulator is well known in the art to which the present invention pertains, and therefore a detailed description thereof will be omitted.

In this embodiment, the cooking appliance may include a child lock input unit 140 in order to provide a child lock function. In the conventional cooking appliance, as described with reference to FIG. 2, the NC type relay must be used in order to provide the child lock function. This is because the cooking appliance is basically in a state in which child lock is not set, and the electric heater must be driven when the mechanical manipulation unit 100 is operated in the basic state. That is, in the basic state, the NC type relay must be used in order to drive the electric heater.

Meanwhile, an NC type DC relay cannot be used for high current, as previously described. For this reason, an NC type AC relay is used in the conventional art.

In this embodiment, the cooking appliance uses an NO type DC relay 120 instead of using an NC type AC relay. That is, an NO mode is primarily used instead of an NC mode, and a DC mode is secondarily used instead of an AC mode, to provide a cooking appliance that is capable of more safely performing child lock with low cost and a control method of the same.

The NO type DC relay 120 is connected in series to the electric heater 110. Consequently, the mechanical manipulation unit 100, the electric heater 110, and the NO type DC relay 120 are sequentially connected between live terminals L1 (positive) and L2 (negative), to which commercial AC power is supplied. In order to operate the electric heater 110, therefore, the mechanical manipulation unit 100 may be primarily turned ON, and the NO type DC relay 120 may be secondarily closed. The DC relay is a relay for selectively interrupting or allowing the supply of AC current. DC means that the relay is operated according to a DC signal.

In this embodiment, therefore, the NO type DC relay 120, which is connected in series to the electric heater 110, is used in order to secondarily operate the electric heater 110. As a result, child lock may be performed even for high current.

Figure 2:
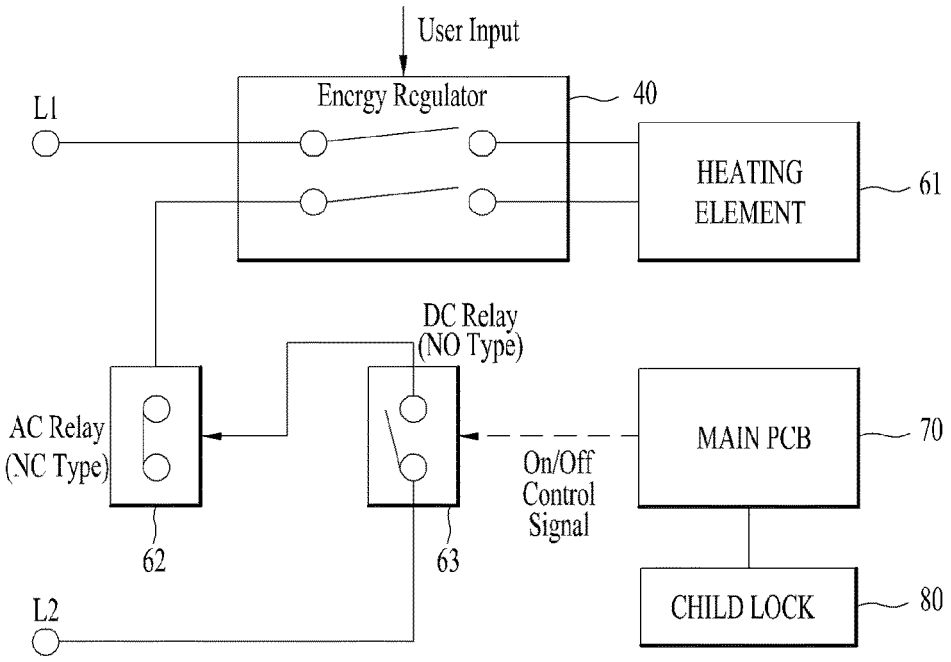
FIG. 2 is a schematic block diagram showing a conventional cooking appliance having a child lock input unit.

A controller 130 may be provided to control the NO type DC relay 120. The controller 130 may be a main printed circuit board (PCB). The main PCB selectively applies a control signal to the DC relay 120 to control the DC relay 120. The main PCB applies a DC signal as a control signal. Since the main PCB applies a DC signal very satisfactorily due to the characteristics of the main PCB, no additional conversion device is needed. For example, an additional DC relay, which is a middle medium for controlling the AC relay, as shown in FIG. 2, is not needed.

According to this embodiment, therefore, the number of components constituting the cooking appliance is reduced, whereby wiring is simplified. In addition, manufacturing cost of the cooking appliance is reduced. Of course, simpler control may result in higher safety.

Figure 1:
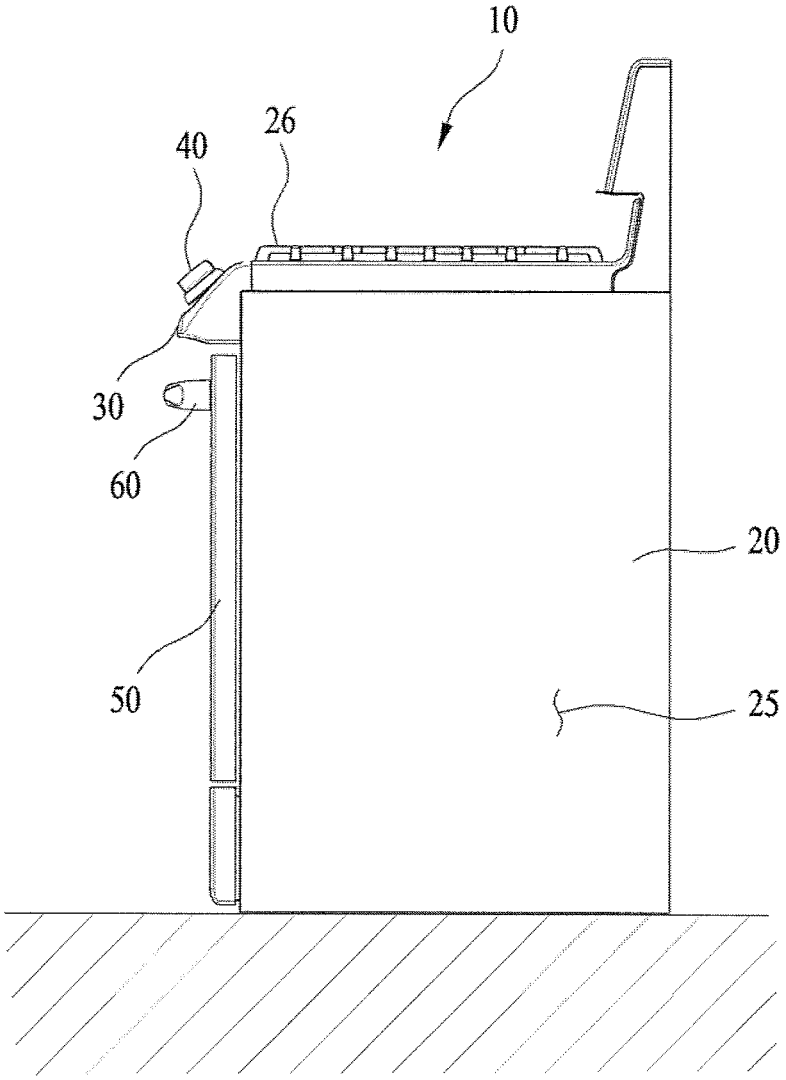
FIG. 1 is a side view showing an example of a general cooking appliance.

The controller 300 may determine whether child lock has been set through the child lock input unit 140. The child lock input unit 140 may be provided at the control panel 30 shown in FIG. 1 in a button shape. A plurality of buttons may be input simultaneously to set child lock.

That is, child lock may be set and released through the child lock input unit 140. Setting and release of child lock may be recognized by the controller 130.

First, upon determining that child lock has been set through the child lock input unit 140, the controller 130 may apply an OFF signal to the DC relay 120. The OFF signal is a signal for disabling the operation of the DC relay. Of course, no signal may be applied not to operate the DC relay. The OFF signal is distinguished from an ON signal. Since the DC relay 120 is not operated, therefore, the DC relay remains open.

Consequently, the electric heater is not driven due to the open state of the DC relay even though the electric heater is primarily turned ON by the mechanical manipulation unit 100. That is, the electric heater is not operated even though the mechanical manipulation unit 100 is manipulated in a state in which child lock is input.

On the other hand, upon determining that child lock has not been set or has been released through the lock input unit 140, the controller 130 may apply an ON signal to the DC relay 120. The ON signal is a signal for enabling the operation of the DC relay. Consequently, the DC relay is operated, and is switched to a closed state. Consequently, the electric heater 110 is finally driven according to primary heater ON by the mechanical manipulation unit 100 and secondary heater ON through the DC relay.

The controller may determine whether the mechanical manipulation unit 100 is being operated or not through a sensor or a photo coupler. That is, the mechanical manipulation unit 100 being operated means that electric current flows in the mechanical manipulation unit 100, and the mechanical manipulation unit 100 not being operated means that the flow of electric current in the mechanical manipulation unit 100 is interrupted. When the electric current flows in the mechanical manipulation unit 100 or when the flow of electric current in the mechanical manipulation unit 100 is interrupted, therefore, the controller 130 may sense potential difference between opposite ends of the sensor or the photo coupler to easily determine whether the mechanical manipulation unit 100 is being operated or not, which may be easily embodied using a lamp 150, which will hereinafter be described.

The relay, connected in series to the electric heater, is converted from an AC relay to a DC relay and from an NC relay to an NO relay to more safely and conveniently perform child lock with low cost.

Hereinafter, wiring and controlling of the cooking appliance according to this embodiment for respective states will be described in detail with reference to FIGS. 4 to 6.

A dashed dotted line indicates wiring between a live terminal L1 (positive) and control elements, a broken line indicates wiring between a live terminal L2 (negative) and control elements, a solid line indicates wiring between control elements. A dotted line indicates a control line. Consequently, the broken line between the control elements means a state in which electric current is flowing. The control elements include a mechanical manipulation unit 100, a lamp 150, a DC relay 120, a main PCB 130, and an electric heater 110.

Figure 4:
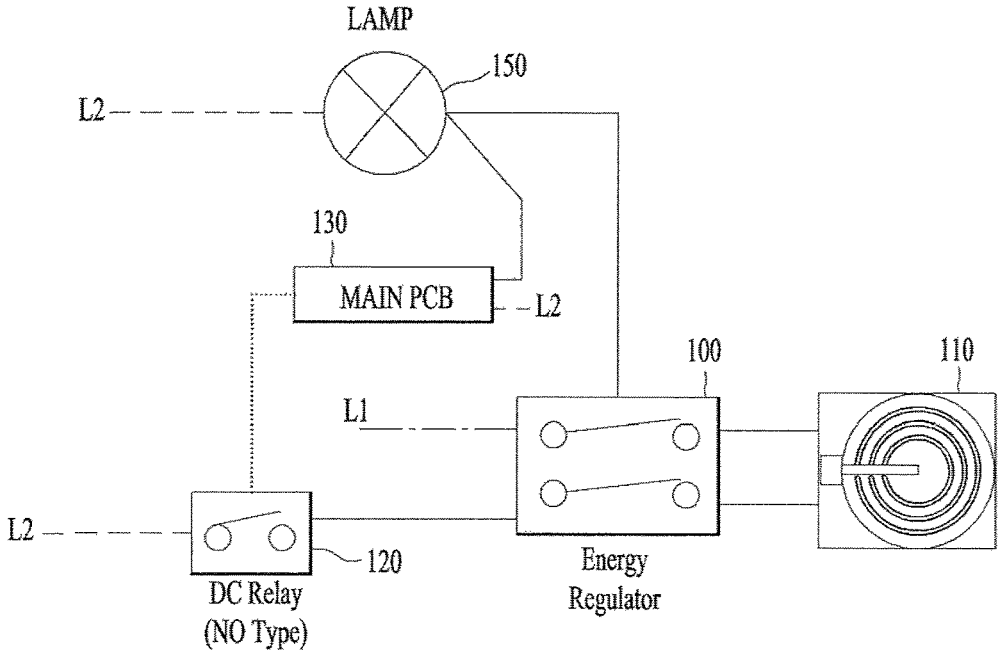

FIG. 4 is a view showing the flow of electric current in an initial state, i.e. a state in which the mechanical manipulation unit 100 is OFF.

The mechanical manipulation unit 100 is a kind of switch. In an OFF state, therefore, the flow of electric current between the mechanical manipulation unit 100 and the electric heater 110 is interrupted. Meanwhile, the lamp 150, connected in series to the mechanical manipulation unit 100 between the live terminal L1 and the live terminal L2, is also in an OFF state. That is, in a state in which the mechanical manipulation unit is OFF, the lamp 150 is also OFF. Consequently, the lamp 150 may visually inform a user of an operation state of the mechanical manipulation unit 100, i.e. an ON/OFF state of the mechanical manipulation unit 100. In this state, as shown in FIG. 4, the lamp 150 does not emit light, and the electric heater 110 is not driven.

Figure 5:
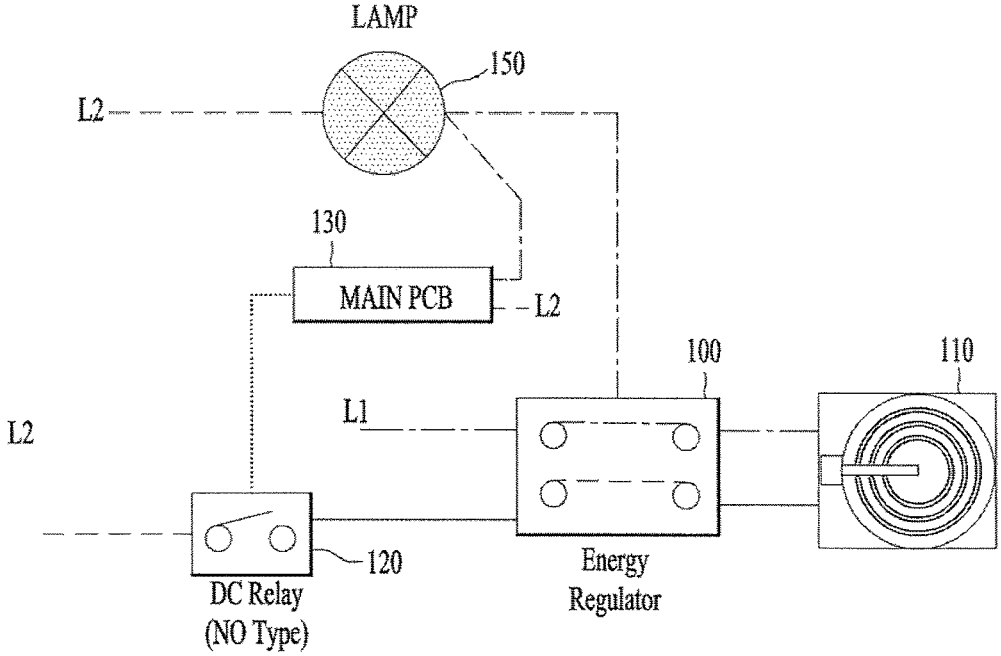

FIG. 5 is a view showing the flow of electric current in a state in which the mechanical manipulation unit 100 is ON.

In a state in which the mechanical manipulation unit 100 is ON, electric current may flow among the live terminal L1, the mechanical manipulation unit 100, and the electric heater 110. In addition, electric current may flow among the live terminal L1, the lamp 150, and the live terminal L2. Consequently, the lamp 150 is switched to an ON state. As a result, a user may recognize from light emitted from the lamp 150 that the mechanical manipulation unit 100 is in an ON state irrespective of driving of the electric heater.

That is, when the mechanical manipulation unit 100 is switched from an OFF state to an ON state, the lamp 150 emits light, whereby the user may easily recognize that the mechanical manipulation unit 100 is in the ON state.

At this time, the flow of electric current among the electric heater 110, the mechanical manipulation unit 100, and the live terminal L2 is interrupted even though the mechanical manipulation unit 100 has been switched to the ON state, since the DC relay is an NO type relay. This is because the DC relay 120 is in an open state.

Meanwhile, when the lamp 150 is switched to an ON state, electric current also flows between the lamp 150 and the controller 130. That is, electric current flows among the live terminal L1, the mechanical manipulation unit 100, the lamp 150, the controller 130, and the live terminal L2. FIG. 5 shows a state in which the lamp 150 has emitted light, and the electric heater 110 has not yet been driven. That is, electric power has primarily been supplied to the electric heater, but electric power has not finally (secondarily) supplied to the electric heater.

In a state shown in FIG. 5, the controller 130 may determine based on the flow of electric current as described above whether the mechanical manipulation unit 100 is in an ON state. In other words, the controller 130 may determine based on an ON/OFF state of the lamp 150 whether the mechanical manipulation unit 100 is in an ON/OFF state.

First, upon determining that the lamp 150 is in an ON state, the controller 130 determines whether child lock has been set through the child lock input unit. That is, the controller 130 determines whether child lock has been set on the premise that the lamp 150 is in an ON state or the mechanical manipulation unit 100 is in an ON state. Upon determining that child lock has not been set or child lock has been released, the controller 130 applies an operation signal to the DC relay. That is, the controller 130 applies a DC signal for closing the DC relay to the DC relay 120. When the DC relay is closed, the electric heater 110 is driven.

Figure 6:
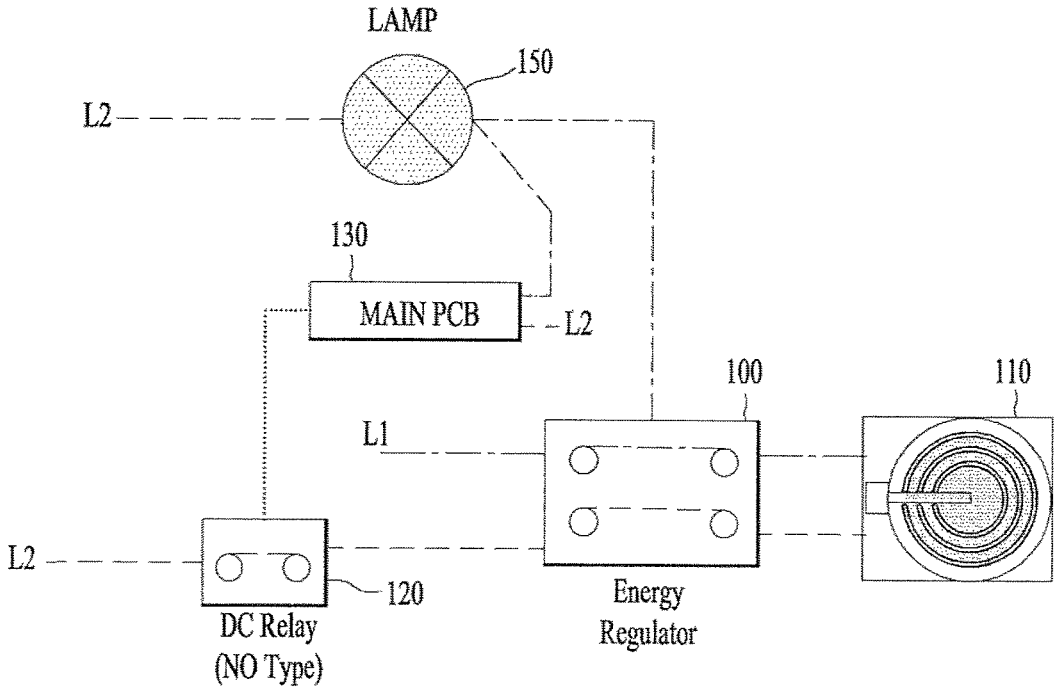

That is, upon the controller 130 determining that there is no child lock in a state shown in FIG. 5, the state shown in FIG. 5 is switched to a state shown in FIG. 6. Consequently, a predetermined time may be required for determination of the controller 130, application of an operation signal to the DC relay, and driving of the electric heater. For example, 1 second may be required. In other words, when the mechanical manipulation unit 100 is switched to an ON state even in a case in which there is no child lock, the electric heater is driven after the lapse of a predetermined time. Of course, when the mechanical manipulation unit 100 is switched to an ON state, the lamp 150 is also immediately switched to an ON state.

The predetermined time is required since it is not possible for the user to easily perceive an initial driving state of the electric heater 110. That is, driving of the electric heater after a short time, e.g. about 1 second, is desirable due to the characteristics of the electric heater 110. This is because users repeatedly rotate the mechanical manipulation unit 100 in alternating directions in order to drive the mechanical manipulation unit 100. When visually informed that the lamp has been turned ON, the user intuitively recognizes that the mechanical manipulation unit 100 has been properly manipulated.

Meanwhile, upon the controller 130 determining that child lock has been set in a state shown in FIG. 5, the state shown in FIG. 5 is maintained. That is, the controller 130 controls the DC relay 120 to remain open. To this end, a DC signal may be applied to open the DC relay 120, or no DC signal may be applied to the DC relay 120. Basically, no DC signal is applied to the DC relay 120 such that the DC relay 120 remains open.

When the child lock has been set on the premise that the mechanical manipulation unit 100 is in an ON state, therefore, the controller 130 controls the supply of electric power to the electric heater 110 to be interrupted. That is, the controller 130 interrupts the supply of electric power to the electric heater 110 through the NO type DC relay 120. That is, even when the mechanical manipulation unit 100 is switched to an ON state, the state shown in FIG. 5 is maintained in a state in which child lock has been set.

In a state in which child lock has been set, therefore, the electric heater 110 is not driven even though a specific user manipulates the mechanical manipulation unit 100. Consequently, it is possible to prevent a specific user, such as a child, from operating the cooking appliance.

The controller 130 may control the DC relay 120 as follows.

First, the controller 130 determines whether the state of the mechanical manipulation unit 100 has been switched from an OFF state to an ON state. At this time, the controller 130 may determine based on light emitted from the lamp 150 or a signal from the sensor or the photo coupler connected to the lamp whether the state of the mechanical manipulation unit 100 has been switched.

Subsequently, the controller 130 determines whether child lock has been set. That is, upon determining that there is no child lock after the state of the mechanical manipulation unit 100 has been switched, the controller 130 switches the DC relay 120 to an On state. On the other hand, upon determining that there is child lock, the controller 130 maintains the DC relay 120 in an OFF state.

FIG. 6 shows a state in which the electric heater 110 is driven as a result of the mechanical manipulation unit 100 being operated in a state in which child lock has not been set. At this time, the user may manipulate the child lock input unit 140 (see FIG. 3). That is, the user may input or release child lock through the child lock input unit 140.

Since the controller 130 has already known a state in which the electric heater 110 is driven, the controller 130 may disable the child lock input unit 140 in a state in which the heater 110 is driven. That is, the controller 130 may control child lock not to be set in a state in which the heater 110 is driven. Since the heater 110 is driven on the premise that child lock has been set, release of child lock does not occur in a state in which the heater 110 is driven.

Conventionally, when child lock is set in a state in which the electric heater 110 is driven, the controller may turn the NC type AC relay OFF. As a result, driving of the electric heater is stopped even though the mechanical manipulation unit is operated. That is, driving of the electric heater is stopped even though a user has not turned the mechanical manipulation unit OFF. As a result, the user may incorrectly determine that the cooking appliance has trouble.

In this embodiment, setting of child lock may be restricted when the electric heater 110 is driven. That is, the controller 130 may disregard a user's input of child lock. Of course, it may not be possible to input child lock. Consequently, it is possible to prevent the operation of the electric heater 110 from being stopped due to user's incorrect input of child lock through the child lock input unit in a state in which the electric heater 110 is driven.

According to this embodiment as described above, it is possible for the controller, i.e. the main PCB, to directly apply a DC signal to the DC relay 120 without additional conversion of the signal. The DC relay 120 may be connected in series to the electric heater 110 such that electric power is directly supplied to the electric heater 110 or the supply of electric power to the electric heater 110 is interrupted. Since an AC relay may be omitted, very simple wiring may be achieved. In addition, since an inexpensive DC relay may be used, total manufacturing cost may be considerably reduced.

Furthermore, since a NO type relay is used, it is possible to secure a short delay time, e.g. about 1 second, between the operations of the mechanical manipulation unit 100 and the electric heater 110. As a result, it is possible to prevent the electric heater 110 from being operated immediately in response to unnecessary manipulation of the mechanical manipulation unit 100. Consequently, it is possible to reduce energy consumption.

As is apparent from the above description, according to an embodiment of the present invention, it is possible to provide a cooking appliance that can be manufactured with low cost and improved workability and a control method of the same.

According to an embodiment of the present invention, it is possible to provide a cooking appliance that is capable of safely driving an electric heater and a control method of the same.

According to an embodiment of the present invention, it is possible to provide a cooking appliance that enables a user to easily control an electric heater and a control method of the same.

According to an embodiment of the present invention, it is possible to provide a cooking appliance that is capable of preventing user's incorrect manipulation, particularly child's incorrect manipulation, by the provision of a child lock input unit and a control method of the same.

According to an embodiment of the present invention, it is possible to provide a cooking appliance that is capable of maintaining the driving of an electric heater even though a child lock input unit is selected a state in which the electric heater is driven, thereby improving convenience in use, and a control method of the same.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A cooking appliance comprising:

an electric heater configured to generate heat for cooking;

a mechanical manipulation unit that is electrically connected to the electric heater, the mechanical manipulation unit being configured to be manipulated by a user to directly control a primary ON/OFF state of the electric heater and a power level of the electric heater;

a normally open type DC relay that is electrically connected to the mechanical manipulation unit;

a child lock input unit configured to set or release a child lock; and a controller that is configured to receive input from the child lock input unit and that is configured to, based on sensing a signal indicating that the mechanical manipulation unit controls the electric heater to be in the primary ON state, control the normally open type DC relay to control a secondary ON/OFF state of the electric heater based on whether the child lock has been set through the child lock input unit, wherein the electric heater is configured to be activated based on both the primary ON/OFF state and the secondary ON/OFF state being controlled to be ON, wherein the mechanical manipulation unit comprises a rotary switch configured to receive an angle input from the user, and a bimetal configured to directly control the power level of the electric heater by mechanically controlling a duty ratio of the electric heater based on the angle input to the rotary switch by the user, and wherein the controller is further configured to disable the child lock input unit in a state in which the electric heater is driven.

2. The cooking appliance according to claim 1, wherein the mechanical manipulation unit is configured to increase the duty ratio of the electric heater based on an increase of the angle input to the rotary switch by the user.

3. The cooking appliance according to claim 1, wherein the electric heater is configured to be operated only when the mechanical manipulation unit is in the primary ON state and the normally open type DC relay is in a closed state.

4. The cooking appliance according to claim 3, wherein the controller is configured to, based on the child lock being set through the child lock input unit, control the normally open type DC relay to be maintained in a normal open state even when the mechanical manipulation unit is in the primary ON state.

5. The cooking appliance according to claim 3, wherein the controller is configured to, based on the child lock not being set through the child lock input unit, control the normally open type DC relay to be switched to a closed state.

6. The cooking appliance according to claim 1, wherein the normally open type DC relay is connected in series to the electric heater.

7. The cooking appliance according to claim 6, wherein the mechanical manipulation unit comprises a double relay, and wherein, in use, commercial AC current sequentially flows along a first live terminal, the mechanical manipulation unit, the electric heater, the mechanical manipulation unit, the normally open type DC relay, and a second live terminal to drive the electric heater.

8. The cooking appliance according to claim 1, further comprising a photo coupler configured to sense an input from the mechanical manipulation to control the primary ON/OFF state of the electric heater.

9. The cooking appliance according to claim 1, further comprising:

a light emitting unit electrically connected to the mechanical manipulation unit, wherein the light emitting unit is configured to be operated based on the mechanical manipulation unit being operated.

10. A cooking appliance comprising:

an electric heater configured to heat an object to be cooked;

a mechanical manipulation unit that is electrically connected to the electric heater and configured to be manipulated by a user in order to drive the electric heater;

a normal open type DC relay that is electrically connected to the mechanical manipulation unit;

a sensor configured to sense a state in which the mechanical manipulation unit is operated;

a child lock input unit configured to set or release a child lock; and a controller that is configured to receive input from the child lock input unit and that is configured to control the normally open type DC relay to be closed in order to drive the electric heater only when both a state in which the mechanical manipulation unit is operated and a state in which child lock has been released through the child lock input unit are satisfied, wherein the controller is further configured to control only an ON/OFF state of the electric heater based on a signal from the sensor indicating that the mechanical manipulation unit is operated, wherein the mechanical manipulation unit comprises a rotary switch configured to receive an angle input from the user, and a bimetal and is configured to directly control a power level of the electric heater by mechanically controlling a duty ratio of the electric heater based on the angle input to the rotary switch by the user, and wherein the controller is further configured to disable the child lock input unit in a state in which the electric heater is driven.

11. The cooking appliance according to claim 10, further comprising a light emitting unit electrically connected to the mechanical manipulation unit and configured to emit light based on the mechanical manipulation unit being operated.

12. The cooking appliance according to claim 11, wherein the sensor comprises a photo coupler provided between the light emitting unit and the controller.

13. The cooking appliance according to claim 1, wherein the controller is further configured to disregard a user input for setting the child lock on the child lock input unit based on the electric heater being driven.

14. The cooking appliance according to claim 1, wherein the child lock input unit includes at least one button configured to set the child lock.

15. The cooking appliance according to claim 10, wherein the child lock input unit includes at least one button configured to set or release the child lock.

* * * * *